US009421777B2

(12) United States Patent
Akahane

(10) Patent No.: US 9,421,777 B2
(45) Date of Patent: Aug. 23, 2016

(54) LIQUID EJECTING APPARATUS

(71) Applicant: SEIKO EPSON CORPORATION, Tokyo (JP)

(72) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/832,523

(22) Filed: Aug. 21, 2015

(65) Prior Publication Data

US 2016/0052280 A1 Feb. 25, 2016

(30) Foreign Application Priority Data

Aug. 22, 2014 (JP) ..... 2014-169945

(51) Int. Cl.

| | |
|---|---|
| ***B41J 2/15*** | (2006.01) |
| ***B41J 2/165*** | (2006.01) |
| ***B41J 29/17*** | (2006.01) |

(52) U.S. Cl.

CPC ..... *B41J 2/16538* (2013.01); *B41J 29/17* (2013.01)

(58) Field of Classification Search

CPC ..... B41J 2/16547; B41J 2202/20; B41J 2202/19; B41J 2/16535; B41J 2/16517; B41J 2002/16576; B41J 29/17

USPC ..... 347/20, 32

See application file for complete search history.

(56) References Cited

FOREIGN PATENT DOCUMENTS

| | | | |
|---|---|---|---|
| JP | 2010-005856 | A | 1/2010 |
| JP | 2013-173264 | A | 9/2013 |

*Primary Examiner* — Lamson Nguyen
(74) *Attorney, Agent, or Firm* — Workman Nydegger

(57) ABSTRACT

A liquid ejecting apparatus includes a liquid ejecting head in which a plurality of head units which eject an ink from a nozzle which is formed in an ejection surface are arranged, and a brush which includes a plurality of bristle members for cleaning a gap which is formed by the head units which are adjacent to each other.

12 Claims, 12 Drawing Sheets

LIQUID EJECTING APPARATUS

CROSS REFERENCES TO RELATED APPLICATIONS

This application claims priority to Japanese Patent Application No. 2014-169945 filed on Aug. 22, 2014. The entire disclosures of Japanese Patent Application No. 2014-169945 is hereby incorporated herein by reference.

BACKGROUND

1. Technical Field

The present invention relates to technology in which a liquid such as ink is ejected.

2. Related Art

In a configuration in which a plurality of head units which eject the liquid from nozzles are arranged, the removal of the liquid which enters gaps between the head units which are adjacent to each other becomes a problem. JP-A-2013-173264 discloses technology in which, by inserting projecting portions of an elastic material into groove portions (joins) between the head units which are adjacent to each other and moving the projecting portions, the groove portions are cleaned. JP-A-2010-005856 discloses a configuration in which an ink which is present in the gaps between the head units which are adjacent to each other is sucked from opening portions which are shaped to correspond to the gaps.

However, since an error may arise in the interval between the gaps of the head units which are adjacent to each other, it is difficult to sufficiently clean the gaps between the head units using the technology of JP-A-2013-173264 and JP-A-2010-005856. For example, when the gaps between the head units are wider than a planned value, the projecting portions of JP-A-2013-173264 or the opening portions of JP-A-2010-005856 do not closely adhere to the inner wall surfaces of the gaps, and, as a result, it is difficult to sufficiently perform the cleaning. Meanwhile, when the gaps between the head units are narrower than the planned value, the projecting portions of JP-A-2013-173264 or the opening portions of JP-A-2010-005856 are not inserted into the gaps, and it is nevertheless difficult to sufficiently perform the cleaning. Note that, in the above description, for convenience, focus was placed on the gaps between the head units which are adjacent to each other; however, a similar problem can occur with regard to a gap which is formed between one head unit and another element (for example, a housing which holds a plurality of head units).

SUMMARY

An advantage of some aspects of the invention is that gap is effectively cleaned even when there is an error in the interval between the gap which is formed by a head unit.

Aspect 1

According to an aspect 1 of the invention, there is provided a liquid ejecting apparatus including: a liquid ejecting head in which a plurality of head units which eject a liquid from a nozzle which is formed in an ejection surface are arranged along a first direction; and a brush which includes a plurality of bristle members for cleaning a gap which is formed by the head units. In the aspect described above, the brush which includes the plurality of bristle members is used in the cleaning of the gap. Since the number of the bristle members of the brush which enter the gap is variable according to the interval of the gap, in comparison to the configuration of JP-A-2013-173264 or JP-A-2010-005856 in which the fixed-shape member is inserted into the gap, there is a merit in that it is possible to effectively clean the gap even when there is an error in the interval of the gap which is formed by the head unit. Note that, a typical example of the gap which serves as the cleaning target of the brush is the gap between the head units which are adjacent to each other; however, it is also possible to apply the invention to the cleaning of the gap between a single arbitrary head unit and another element (for example, a member such as the housing which holds the plurality of head units).

Aspect 2

In the liquid ejecting apparatus according to a preferred example of the aspect 1 (aspect 2), in which the gap which is formed by the head units may extend along a second direction which intersects the first direction, and in which a dimension of a bristle sheaf of the plurality of bristle members in a third direction which orthogonally intersects the second direction be greater than an interval of the gap. In the aspect described above, since the dimension of the bristle sheaf in the third direction is greater than the interval of the gap, the previously described effect of being able to effectively clean the gap even when there is an error in the interval of the gap is especially remarkable.

Aspect 3

In the liquid ejecting apparatus according to a preferred example of the aspect 1 or 2 (aspect 3), in which the length of the plurality of bristle members may be selected such that a tip of each of the bristle members of the plurality of bristle members other than the bristle members which enter the gap does not reach the nozzle. In the aspect described above, the length of each of the bristle members is selected such that the tip of each of the bristle members of the plurality of bristle members which does not enter the gap does not reach the nozzle. Therefore, it is possible to prevent a situation in which the tips of the bristle members of the brush enter the inside of the nozzle and destroy the liquid meniscus.

Aspect 4 and Aspect 5

In the liquid ejecting apparatus according to a preferred example of the aspects 1 to 3 (aspect 4), in which a diameter of each of the bristle members may be smaller than an inner diameter of the nozzle. In the aspect described above, since the bristle member with a smaller diameter than the inner diameter of the nozzle is arranged, there is a merit in that it is possible to sufficiently secure the capillary force which absorbs and holds the liquid of the gap which is formed by the head units. Meanwhile, according to the aspect (aspect 5) in which the diameter of each of the bristle members is greater than the inner diameter of the nozzle, since the tips of the bristle members do not enter the inner portion of the nozzle, there is a merit in that it is possible to prevent the destruction of the meniscus of the inner portion.

Aspect 6

In the liquid ejecting apparatus according to a preferred example of the aspects 1 to 5 (aspect 6), in which the gap which is formed by the head units may extend along a second direction which intersects the first direction, and in which the brush may move relative to the gap along the second direction. In the aspect described above, since the brush moves relative to the gap along the direction in which the gap which is formed by the head units extends, there is a merit in that it is possible to effectively remove the liquid within the gap.

Aspect 7

According to a preferred example of the aspects 1 to 6 (aspect 7), there is provided a liquid ejecting apparatus further including a wiper member which wipes the ejection surface, in which after the gap is cleaned by the brush, the wiper member wipes the ejection surface. In the aspect described above, since the wiper member wipes the ejection surface after the gap is cleaned by the brush, there is a merit in that it is possible to remove the liquid, which moves from the gap to the ejection surface in the cleaning by the brush, by wiping the liquid with the wiper member.

Aspect 8

In the liquid ejecting apparatus according to a preferred example of the aspects 1 to 5 (aspect 8), in which the gap which is formed by the head units may extend along a second direction which intersects the first direction, and in which the brush may rotate around a rotational axis which is parallel to the ejection surface and orthogonally intersects the second direction. In the aspect described above, since the brush rotates around the rotational axis which is parallel to the ejection surface and orthogonally intersects the second direction, there is a merit in that it is possible to efficiently remove the liquid of the gap which is formed by the head units.

Aspect 9

In the liquid ejecting apparatus according to a preferred example of the aspects 1 to 5 (aspect 9), in which the brush may move relative to the ejection surface along a direction perpendicular to the ejection surface. In the aspect described above, since the brush moves relative to the ejection surface along the direction which is perpendicular to the ejection surface, there is a merit in that it is possible to suppress the splashing of the liquid within the gap in comparison to a configuration in which the brush is caused to move along the direction in which the gap which is formed by the head units extends.

Aspect 10

According to a preferred example of the aspect 9 (aspect 10), there is provided a liquid ejecting apparatus further including a cap member which seals the ejection surface, in which the brush moves relative to the ejection surface with the cap member. In the aspect described above, since the brush moves relative to the ejection surface with the cap member, in comparison to a configuration in which the brush and the cap member are caused to move independently from each other, there is a merit in that the configuration and processes for controlling the brush and the cap member are simplified.

Aspect 11

According to a preferred example of the aspects 1 to 10 (aspect 11), there is provided a liquid ejecting apparatus further including a removal unit which removes a liquid which adheres to the brush from the brush. In the aspect described above, since the removal unit which removes the liquid which adheres to the brush is disposed, there is a merit in that it is possible to reduce the likelihood of the liquid which adheres to the brush in the cleaning of the gap re-adhering to the gap or another location.

Aspect 12

In the liquid ejecting apparatus according to a preferred example of the aspects 1 to 11 (aspect 12), in which a side surface of the head unit may include a first region and a second region which is positioned on the ejection surface side in a direction perpendicular to the ejection surface from a perspective of the first region, in which the second region may have a higher hydrophobicity than the first region, and in which of the plurality of bristle members, a tip of each of the bristle members which enters the gap may reache the first region. In a configuration in which the hydrophobicity of the first region is low in comparison to the second region of the ejection surface side, there is a tendency for the liquid to be easily retained in the space which is interposed by the first regions of the head units. In the aspect described above, since the tips of the bristle members which enter the gap reach the first region, there is a merit in that it is possible to effectively remove the liquid which is retained in the space corresponding to the first region.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
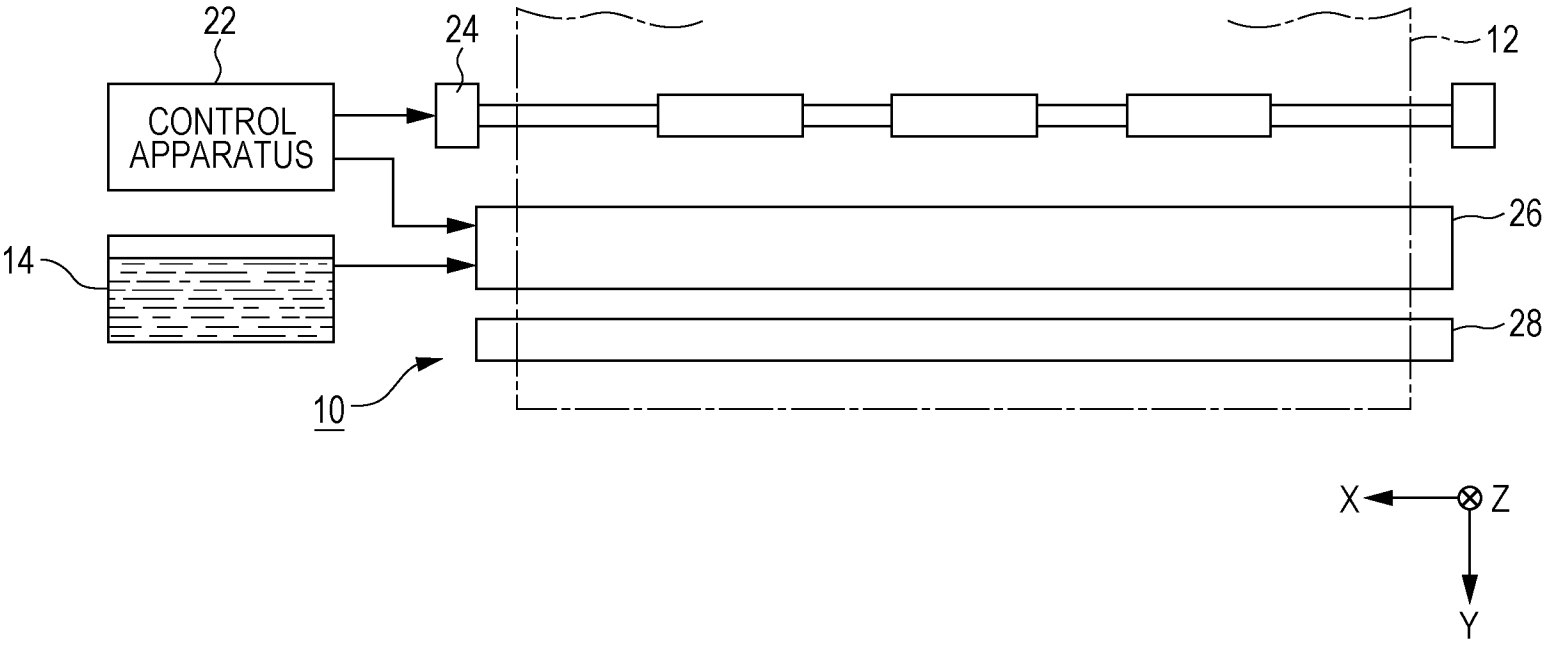
FIG. 1 is a configuration diagram of a printing apparatus according to a first embodiment of the invention.

FIG. 1 is a configuration diagram illustrating a portion of an ink jet printing apparatus 10 according to the first embodiment of the invention. The printing apparatus 10 of the first embodiment is a liquid ejecting apparatus which ejects an ink, which is an example of the liquid, onto a medium (an ejection target) 12 such as printing paper, and is provided with a control apparatus 22, a transport mechanism 24, a liquid ejecting head 26, and a cleaning mechanism 28. A liquid container (a cartridge) 14 which stores the ink is mounted to the printing apparatus 10.

The control apparatus 22 performs the overall control of each element of the printing apparatus 10. The transport mechanism 24 transports the medium 12 along a Y direction under the control of the control apparatus 22. The liquid ejecting head 26 ejects the ink which is supplied from the liquid container 14 onto the medium 12 under the control of the control apparatus 22. The liquid ejecting head 26 of the first embodiment is a line head which is long in an X direction which intersects (typically, orthogonally intersects) the Y direction. A desires image is formed on the surface of the medium 12 due to the liquid ejecting head 26 ejecting the ink onto the medium 12 in parallel with the transportation of the medium 12 by the transport mechanism 24. Note that, a direction which is perpendicular to the X-Y plane (a surface which is parallel with the surface of the medium 12) will be referred to as a Z direction hereinafter. The ejection direction (downward in the vertical direction) of the ink by the liquid ejecting head 26 corresponds to the Z direction.

Figure 2:
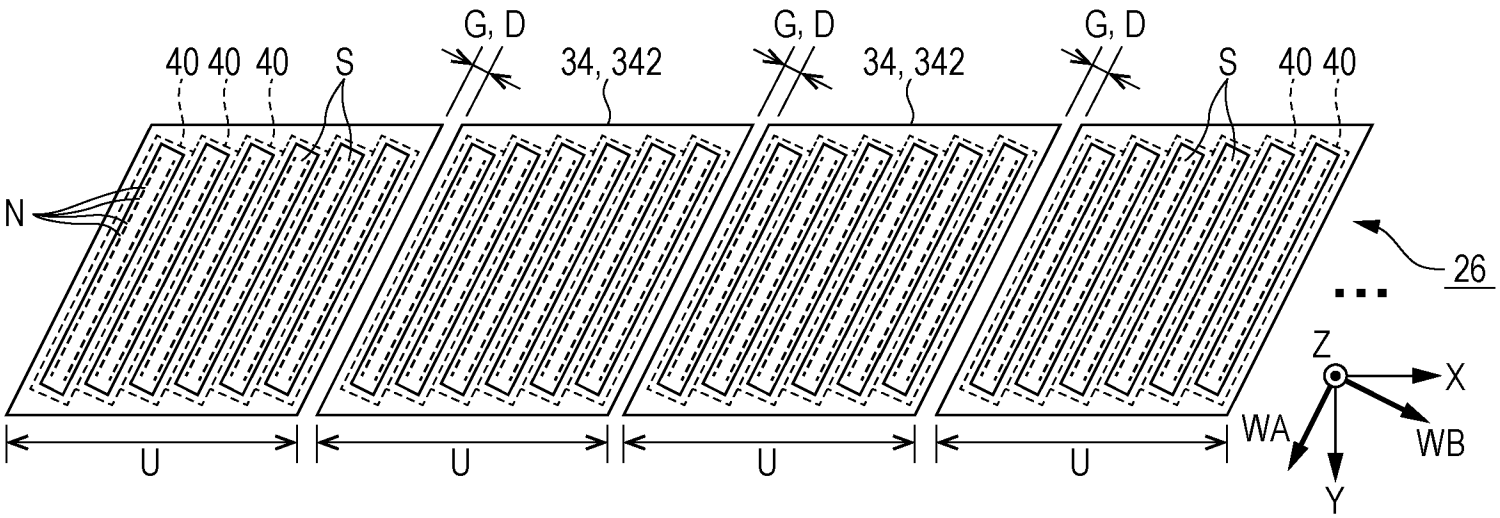
FIG. 2 is a plan view of a liquid ejecting head.
Figure 3:
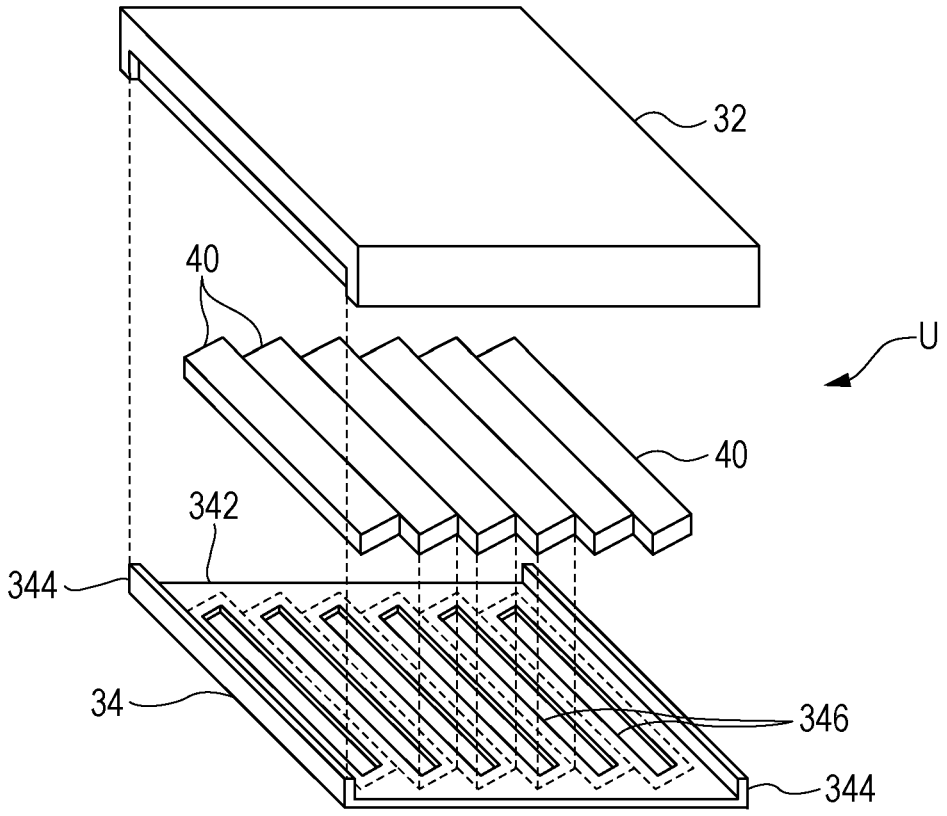
FIG. 3 is an exploded perspective diagram of a head unit.

FIG. 2 is a plan view of a surface of the liquid ejecting head 26 which faces the medium 12. As exemplified in FIG. 2, the liquid ejecting head 26 is provided with a plurality of head units U which are lined up along the X direction. FIG. 3 is an exploded perspective diagram of an arbitrary one of the head units U of the liquid ejecting head 26. As exemplified in FIGS. 2 and 3, each of the head units U includes a support body 32, a fixing plate 34, and a plurality of liquid ejecting units 40. The support body 32 is a housing which supports the plurality of liquid ejecting units 40.

Each of the liquid ejecting units 40 is a head chip which ejects the ink from a plurality of nozzles (ejection holes) N which are formed in a surface (hereinafter, referred to as an "ejection surface") S of the positive side of the Z direction. For example, the liquid ejecting unit 40 is configured to include a plurality of sets (not shown) of a pressure chamber and a piezoelectric element, where each set corresponds to a different nozzle N. The ink which fills the pressure chamber is ejected from the corresponding nozzle N due to the supply of a drive signal causing the piezoelectric element to vibrate to change the pressure inside the pressure chamber. The surface of the nozzle plate on which the plurality of nozzles N is formed corresponds to the ejection surface S. As exemplified in FIG. 2, the plurality of liquid ejecting units 40 is arranged along the X direction.

As exemplified in FIG. 3, the fixing plate 34 includes a plate portion 342 and edge portions 344. The plate portion 342 is a planar plate shape which is parallel to the X-Y plane, and the edge portions 344 continue along the edges of both sides in the X direction of the plate portion 342. The plurality of liquid ejecting units 40 are fixed to the surface of the plate portion 342. Opening portions 346 which expose the ejection surfaces S of the liquid ejecting units 40 are formed in the plate portion 342. Each of the edge portions 344 is a portion which is folded in the negative side of the Z direction in relation to the plate portion 342, and, for example, is fixed to the support body 32 using an adhesive. The fixing plate 34 of the first embodiment is formed of a highly rigid material (for example, stainless steel), and the surface thereof is rendered hydrophobic by being subjected to well-known water repellent finishing.

As can be understood from FIG. 2, the plurality of nozzles N of each of the liquid ejecting units 40 is arranged along a WA direction in the X-Y plane. The WA direction is a direction within the X-Y plane which intersects the X direction and the Y direction in a non-perpendicular manner. Specifically, the WA direction is inclined at an angle from 30° to 60° in relation to the Y direction. As described above, since the plurality of nozzles N is arranged along the WA direction which is inclined in relation to the Y direction in which the medium 12 is transported, in comparison to a configuration in which the plurality of nozzles N is arranged in a straight line along the X direction, it is possible to increase the effective dot density (the resolution) in the X direction of the medium 12. As can be understood from FIG. 2, the planar external shape of the plate portion 342 of the fixing plate 34 in the first embodiment is a planar rectangular shape which is demarcated by the edges which extend in the WA direction and the edges which extend in the X direction.

As exemplified in FIG. 2, gaps G are present between the head units U which are adjacent to each other in the X direction. As described earlier, since the edges which are positioned on both sides of the plate portion 342 of the fixing plate 34 in the X direction extend along the WA direction, the gaps G extend along the WA direction in plan view. There is a likelihood that the ink which is ejected from the nozzles N of each of the liquid ejecting units 40 will enter the gaps G. The ink which is retained in the gaps G may adhere to the surface of the medium 12 which passes the proximity of the fixing plate 34 of each of the head units U. In consideration of the issues described above, the printing apparatus 10 of the first embodiment is provided with a cleaning mechanism 28 for cleaning the gaps G of the head units U.

Figure 4:
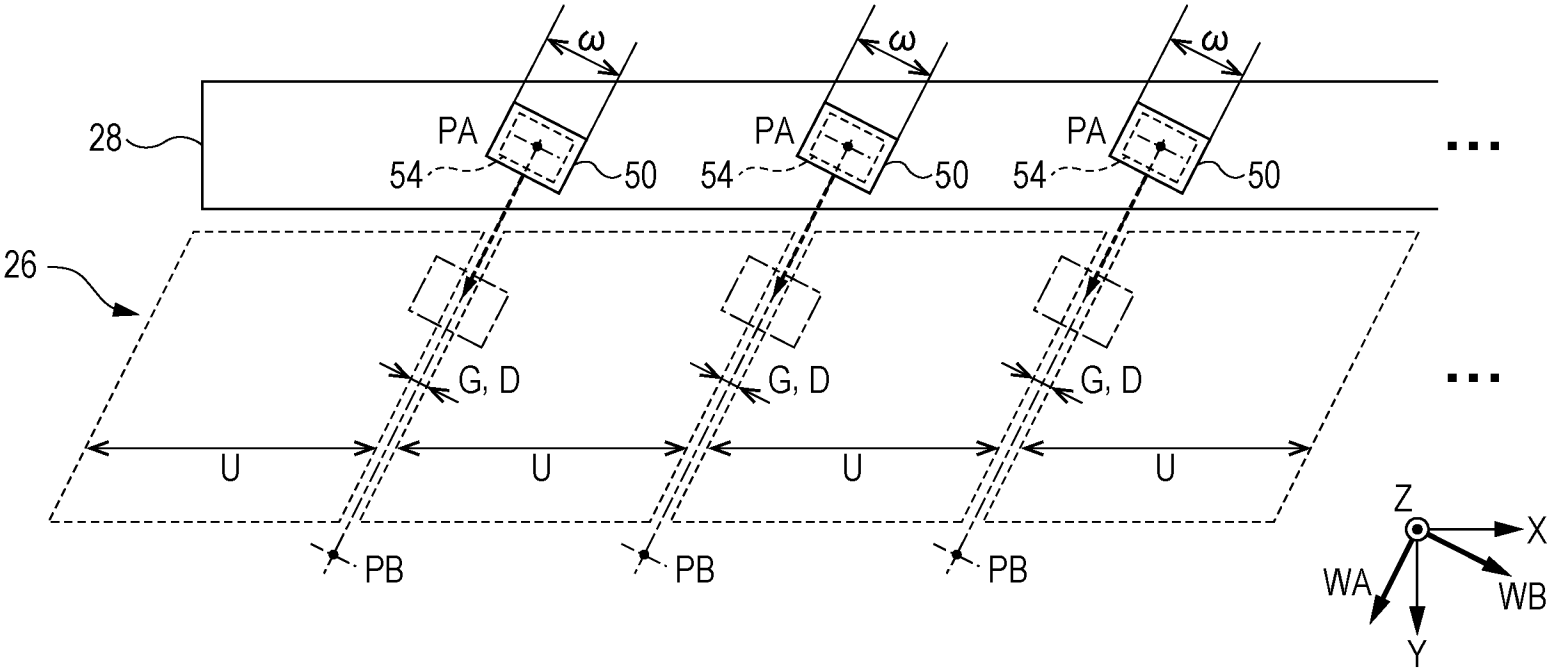
FIG. 4 is a configuration diagram of a cleaning mechanism.

FIG. 4 is a plan view of the cleaning mechanism 28 as viewed from the positive side (the medium 12 side) of the Z direction. The external shape of each of the head units U is also depicted in FIG. 4. As exemplified in FIG. 4, the cleaning mechanism 28 is provided with a plurality of brushes 50, each of which corresponds to a different one of the gaps G of the liquid ejecting head 26. The plurality of brushes 50 is arranged along the X direction, and each of the brushes 50 is positioned on a line extending from the corresponding gap G in plan view. An arbitrary one of the brushes 50 of the cleaning mechanism 28 is used in the cleaning of the gap G which corresponds to the aforementioned brush 50.

Figure 5:
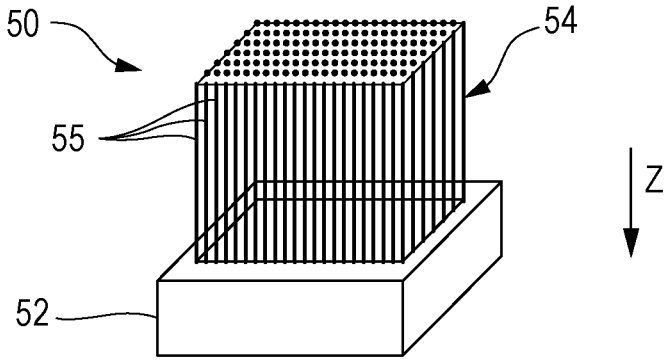
FIG. 5 is a perspective diagram of a brush.

FIG. 5 is a perspective diagram of an arbitrary one of the brushes 50. As exemplified in FIG. 5, the brush 50 of the first embodiment includes a base portion 52 and a bristle sheaf 54. The base portion 52 is a planar shape, and the bristle sheaf 54 is disposed on the surface of the base portion 52 which faces the liquid ejecting head 26. The bristle sheaf 54 is a collection of a plurality of bristle members 55 which are bound together in a state of being aligned substantially along the same direction (the Z direction). Each of the plurality of bristle members 55 which form the bristle sheaf 54 is a thin, long line-shaped object with a circular cross-section, and is formed of a material which is capable of elastic deformation. The material of the bristle members 55 is arbitrary; however, in addition to a line-shaped material which is formed of a resin material such as polypropylene, for example, being favorable used as the bristle member 55, it is also possible to use vegetable fiber or animal hair as the bristle member 55.

When the bristle strength of the bristle members 55 which form the bristle sheaf 54 is excessively low, it becomes difficult to sufficiently remove the ink inside the gaps G, and, when the bristle strength of the bristle members 55 is excessively high, it becomes difficult to cause the multiple bristle members 55 to enter the gaps G. The total length, the diameter, and the material of the bristle members 55 are selected such that the bristle strength is adjusted to fall within an appropriate range at which the problems exemplified above do not occur. Specifically, a configuration in which the bristle strength (a 7 mm bristle strength) of each bristle member 55 is a numerical value within a range of 50 $N/cm^2$ to 85 $N/cm^2$ (more favorably, within a range of 60 $N/cm^2$ to 75 $N/cm^2$), for example, is favorable. Note that, the bristle strength is measured using a method defined in the Japanese Industrial Standard (JIS) S3016.

As exemplified in FIG. 4, a dimension (a horizontal width) ω of the bristle sheaf 54 in the WB direction which orthogonally intersects the WA direction in the X-Y plane is greater than an interval (a dimension in the WB direction) D of the gap G between the head units U. The interval D is the distance between the side surfaces of the head units U which face each other to interpose the gap G. Note that, there may be an error in the interval D of each of the gaps G, caused by an error in the dimensions of the elements which form the head units U of the liquid ejecting head 26. Although it is possible to adjust the positions of the head units U so as to render the intervals D of the gaps G of the head units U uniform, since the positions of the head units U are adjusted such that each of the nozzles N of each of the head units U is actually positioned at a target point (in other words, using the nozzles N as a reference), there is an issue in which an error may inescapably arise in the intervals D of the gaps G of the head units G. The dimension ω of the bristle sheaf 54 of each of the brushes 50 is selected so be greater than an anticipated maximum value of the interval D, taking errors such as those described above into account. The diameter of each of the bristle members 55 is small in comparison to the inner diameter of each of the nozzles N of the liquid ejecting unit 40. For example, since the inner diameter of each of the nozzles N is 20 μm, a bristle member 55 with an inner diameter of less than 20 μm is used favorably in the brush 50.

As illustrated by the broken line arrows in FIG. 4, the cleaning mechanism 28 moves in relation to the liquid ejecting head 26 under the control of the control apparatus 22. Specifically, as exemplified in FIG. 4, the cleaning mechanism 28 of the first embodiment moves along the WA direction in relation to the liquid ejecting head 26 such that each of the plurality of brushes 50 moves in a straight line along the WA direction from a point PA to a point PB. The point PA and the point PB are positioned on opposite sides from each other in plan view to interpose the liquid ejecting head 26.

Figure 6:
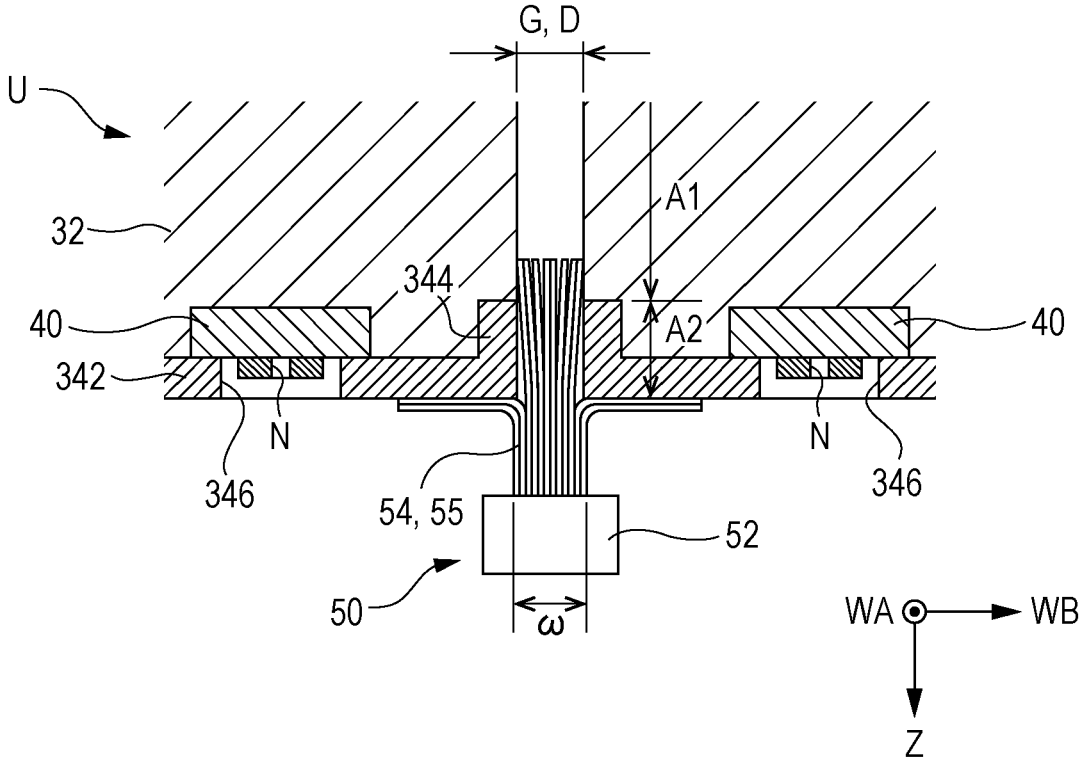
FIG. 6 is an explanatory diagram of the relationship between the brush and the head unit.
Figure 7:
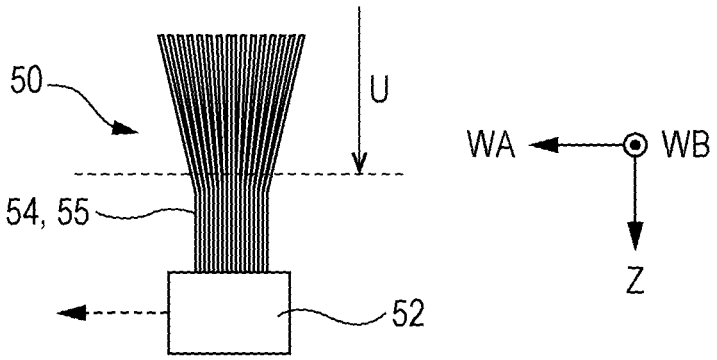
FIG. 7 is an explanatory diagram of the relationship between the brush and the head unit.

FIGS. 6 and 7 are schematic diagrams of a state in which an arbitrary one of the brushes 50 is positioned (in a position between the point PA and the point PB) to overlap the liquid ejecting head 26 in plan view as depicted by the broken lines in FIG. 4. FIG. 6 depicts the state of the brush 50 as viewed from the WA direction, and FIG. 7 depicts the state of the brush 50 as viewed from the WB direction.

As exemplified in FIG. 6, a portion of the bristle sheaf 54 of each of the brushes 50 is positioned on the inside of the gap G between the head units U in a state of being positioned part way along the line from the point PA to the point PB. Specifically, the tip sides of the bristle members 55 of the portion of the center side of the bristle sheaf 54 in the WB direction enter the gap G. Meanwhile, the bristle members 55 of the bristle sheaf 54 which do not enter the gap G (the bristle members 55 of both end sides of the bristle sheaf 54 in the WB direction) make contact with the surface of the plate portion 342 and bend elastically. As exemplified in FIG. 7, the plurality of bristle members 55 of the bristle sheaf 54 which enter the gap G bend elastically such that the tip side is expanded in comparison to the baser side (the plate portion 342 side).

Each of the brushes 50 of the cleaning mechanism 28 proceeds in the WA direction toward the point PB from the point PA in a state in which the plurality of bristle members 55 of the bristle sheaf 54 is maintained in the shape which is exemplified above. According to the configuration described above, the ink which is retained in the gap G is absorbed and held by the inner portion of the bristle sheaf 54 due to the capillary force of the plurality of bristle members 55 of the bristle sheaf 54 of each of the brushes 50 which enters the corresponding gap G. Therefore, the ink which is retained by the gaps G of the head units U is removed by causing the brushes 50 to move in the WA direction from the point PA to the point PB.

The number of the bristle members 55 of the bristle sheaf 54 of each of the brushes 50 which enter the inside of the gap G changes according to the interval D of the gap G. Specifically, the greater the interval D of the gap G, the more the number of the bristle members 55 of the bristle sheaf 54 which enter the corresponding gap G increases. Therefore, according to the first embodiment, in comparison to the configurations of JP-A-2013-173264 and JP-A-2010-005856 in which a fixed-shape member (the projecting portion in JP-A-2013-173264 and the opening portion in JP-A-2010-005856) is inserted into a gap, there is a merit in that it is possible to effectively clean the gap G even when there is an error in the interval D of the gap G between the head units U. In the first embodiment, since the dimension ω of the bristle sheaf 54 in the WB direction exceeds the interval D of the gap G, the effect of being able to effectively clean the gap G even when there is an error in the interval D is especially remarkable. In particular, in the first embodiment, since the bristle members 55, each of which has a small diameter of a degree which is less than the inner diameter of the nozzle N of the liquid ejecting unit 40, are arranged at a high density, for example, in comparison to a configuration in which the diameter of the bristle member 55 exceeds the inner diameter of the nozzle N (a configuration in which the bristle member 55 is thick), there is a merit in that it is possible to sufficiently secure the capillary force which absorbs and holds the ink in the gap G.

As exemplified in FIG. 6, the side surface of an arbitrary one of the head units U which faces another head unit U which is adjacent thereto in the X direction includes a first region A1 and a second region A2. The second region A2 is positioned on the positive side in the Z direction (the ejection surface S side) as viewed from the first region A1. In the first embodiment, the surface of the support body 32 which supports the plurality of liquid ejecting units 40 corresponds to the first region A1, and the surface of each of the edge portions 344 of the fixing plate 34 corresponds to the second region A2.

As described earlier, since the surface of the fixing plate 34 is rendered hydrophobic, the hydrophobicity of the first region A1 is low in comparison to the second region A2. Therefore, there is a tendency for the ink, which enters the gap G between two of the head units U which are adjacent to each other in the X direction, to be easily retained in the space in which the first regions A1 of the gaps G of the head units U face each other. In consideration of the tendency described above, in the first embodiment, the total length of each of the bristle members 55 of the bristle sheaf 54 is selected such that the tip of each of the bristle members 55 of the bristle sheaf 54 of each of the brushes 50 which enters the gap G reaches the first region A1. Therefore, there is a merit in that it is possible to effectively remove the ink which is retained in the space of the first region A1 in the gap G.

As exemplified in FIG. 6, in the first embodiment, the total length of the plurality of bristle members 55 is selected such that the tips of the plurality of bristle members 55 (the plurality of bristle members 55 of the bristle sheaf 54 other than the bristle members 55 which enter the gap G) of the bristle sheaf 54 of each of the brushes 50 which are positioned outside of the gap G do not reach the nozzles N of the liquid ejecting unit 40. In a configuration in which the tips of the plurality of bristle members 55 of the bristle sheaf 54 which are positioned outside of the gap G reach the nozzles N (a configuration in which the total length of each of the bristle members 55 is sufficiently long), there is a likelihood that the tips of the bristle members 55 will make contact with the meniscus (a curved liquid surface caused by surface tension) of the ink which is formed on the inside of the nozzle N, resulting in the meniscus being broken and bubbles entering the nozzle N. In a configuration in which the diameter of the bristle member 55 is less than the inner diameter of the nozzle N, as in the first embodiment, particularly, since the tip of the bristle member 55 easily enters the inner portion of the nozzle N, there is an issue in that the destruction of the meniscus occurs easily. In consideration of the issues described above, in the first embodiment, the total length of the bristle member 55 is selected such that the tip of the bristle member 55 which is positioned outside of the gap G does not reach the nozzle N. In other words, the tip of the bristle member 55 does not make contact with the meniscus of the inner portion of the nozzle N. Therefore, regardless of the configuration in which the bristle member 55 with a smaller diameter than the inner diameter of the nozzle N in order to sufficiently secure the capillary force, it is possible to realize the remarkable effect in that it is possible to prevent the destruction of the meniscus (in addition to the entrance of bubbles caused by the destruction).

Second Embodiment

Next, description will be given of the second embodiment of the invention. In each embodiment exemplified hereinafter, the reference numerals which are used in the description of the first embodiment will be reused for elements which have the same operations and functions as those in the first embodiment, and the detailed description of such elements will be omitted as appropriate.

Figure 8:
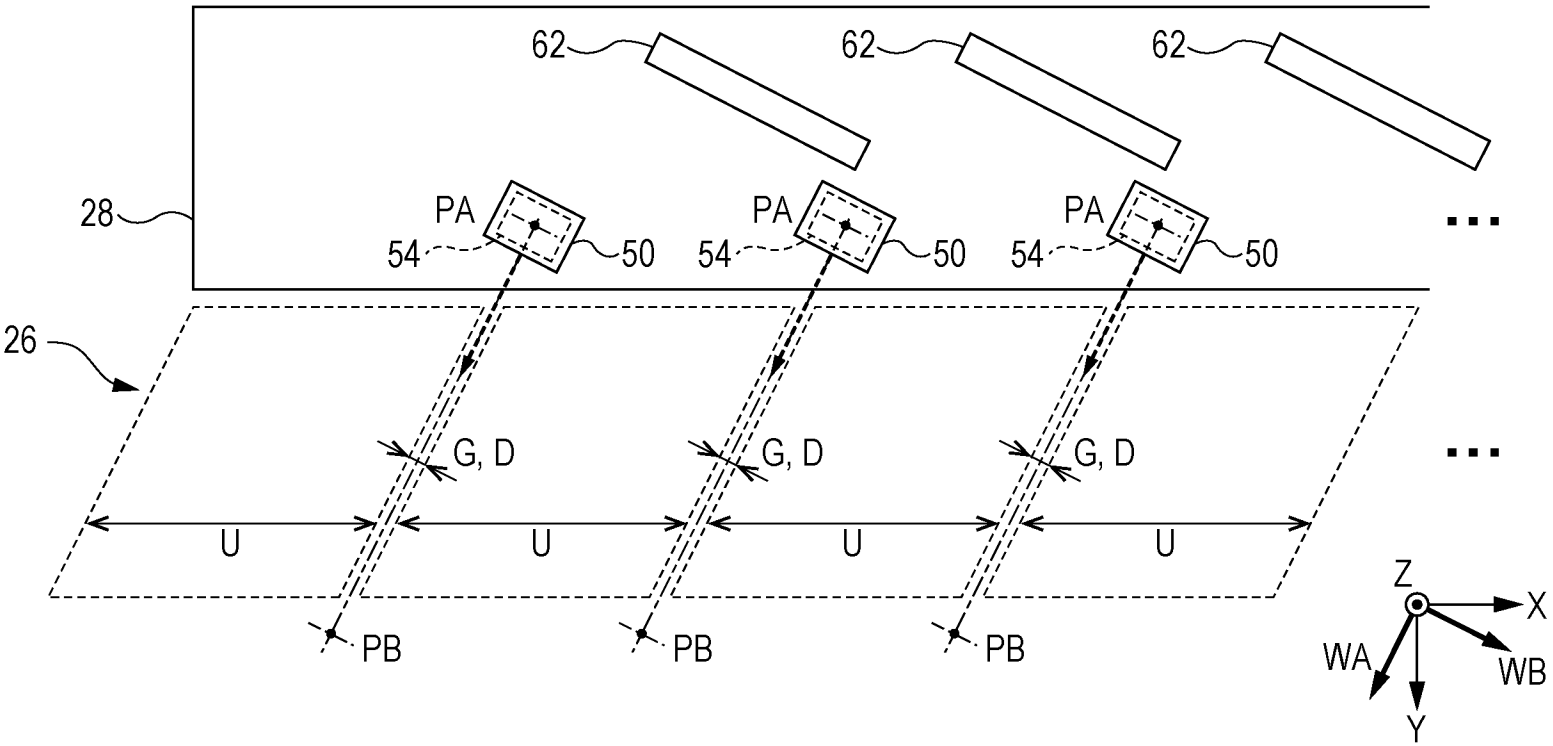
FIG. 8 is a configuration diagram of a cleaning mechanism in a second embodiment.

FIG. 8 is a plan view of the cleaning mechanism 28 in the second embodiment as viewed from the positive side of the Z direction. As exemplified in FIG. 8, in addition to the plurality of brushes 50 which are the same as those in the first embodiment, the cleaning mechanism 28 of the second embodiment is provided with a plurality of wiper members 62 corresponding to the different head units U. Each of the plurality of wiper members 62 is used to wipe the ink which adheres to the contact surface of the liquid ejecting unit 40. As exemplified in FIG. 8, each of the wiper members 62 of the second embodiment is formed in a shape which is long along the WB direction so as to span the interval of the brushes 50 which are adjacent to each other in the WB direction as viewed from the WA direction.

The plurality of wiper members 62 moves along the WA direction with the plurality of brushes 50. For example, the plurality of brushes 50 and the plurality of wiper members 62 are disposed on a shared member. The ink of the ejection surface S is wiped off due to each of the wiper members 62 moving along the WA direction in a state of being in contact with the ejection surface S of each of the liquid ejecting units 40. As exemplified in FIG. 8, each of the wiper members 62 is positioned on the downstream side of each of the brushes 50 in the WA direction in which the cleaning mechanism 28 moves. Therefore, after the gaps G are cleaned by the brushes 50, the wiper member 62 wipes the ejection surfaces S of the liquid ejecting units 40.

The same effect as in the first embodiment is also realized in the second embodiment. In the second embodiment, since the wiper member 62 which wipes the ejection surface S is disposed in addition to the brush 50 which cleans the gap G, it is possible to effectively clean the liquid ejecting head 26. In particular, in the second embodiment, since the wiper members 62 wipe the ejection surfaces S after the brushes 50 clean the gaps G, there is a merit in that it is possible to remove the ink which is swept out onto the ejection surfaces S from the gaps G in the cleaning of the gaps G by the brushes 50 due to wiping of the ejection surface S by the wiper member 62. Since each of the brushes 50 moves with the wiper member 62, in comparison to a configuration in which the brush 50 is moved independently from the wiper member 62, there is a merit in that the configuration and processes for controlling the cleaning mechanism 28 are simplified.

Note that, the ink which adheres to the ejection surface S may move to the inner portion of the gap G due to use wiping performed by the wiper member 62. However, since the ink within the gap G is absorbed and held in the bristle sheaf 54 of the brush 50 before the wiping by the wiper member 62, it is possible to avoid a situation in which a large amount of the ink of a degree which adheres to the medium 12 is retained in the gap G even taking into account the entrance of the ink caused by the wiping by the wiper member 62.

Third Embodiment

Figure 9:
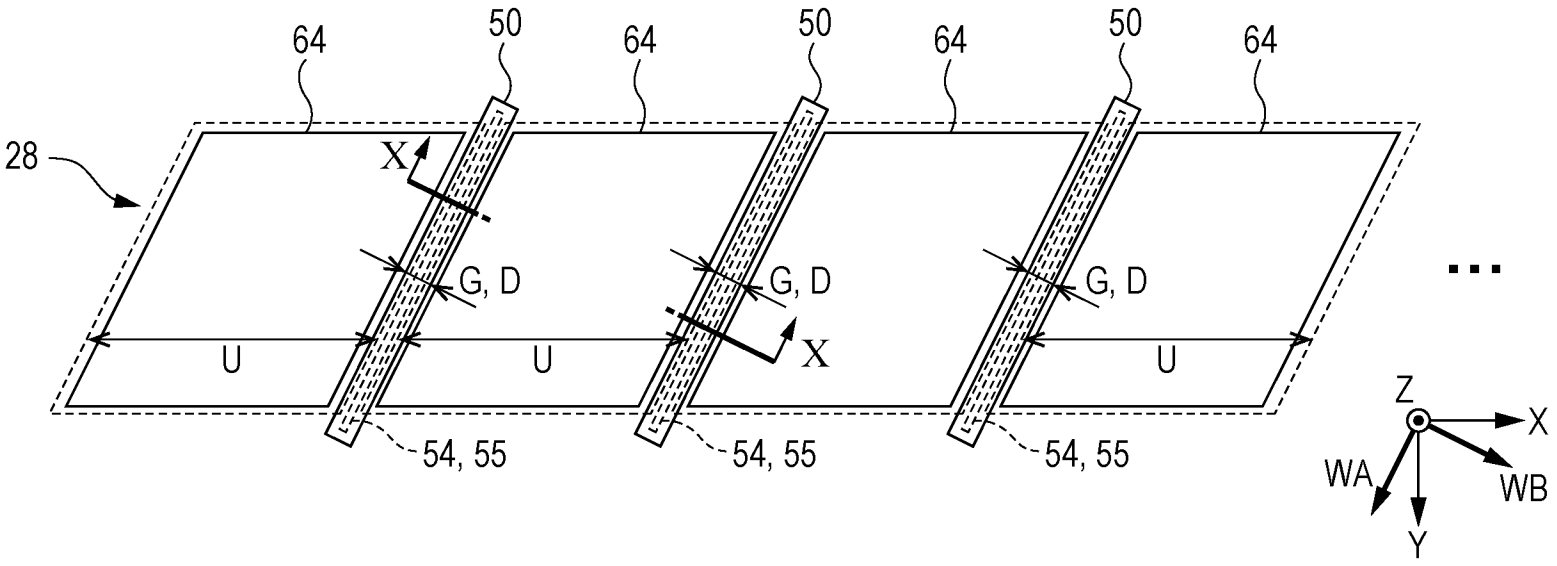
FIG. 9 is a configuration diagram of a cleaning mechanism in a third embodiment.
Figure 10:
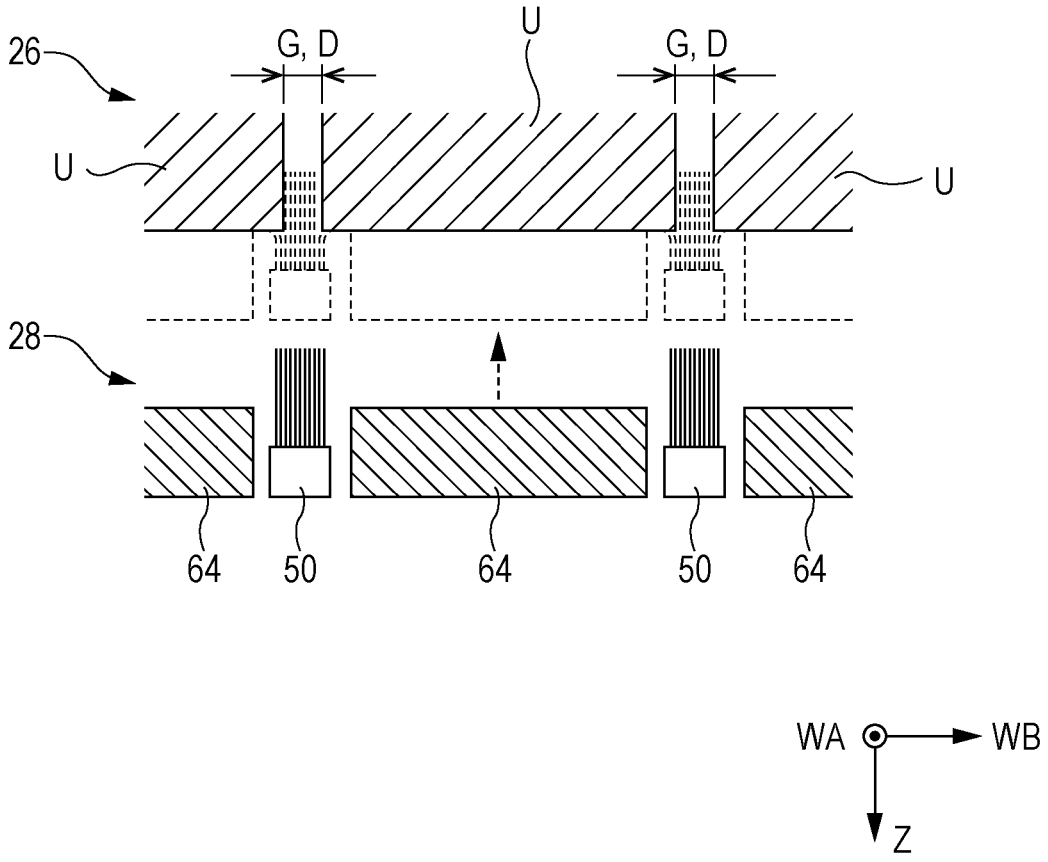
FIG. 10 is an explanatory diagram of a cleaning operation in the third embodiment.

FIG. 9 is a plan view of the cleaning mechanism 28 in the third embodiment as viewed from the positive side of the Z direction, and FIG. 10 is a cross sectional diagram taken across the line X-X in FIG. 9. As exemplified in FIGS. 9 and 10, the cleaning mechanism 28 of the third embodiment is provided with the plurality of brushes 50 corresponding to the gaps G of the head units U, and a plurality of cap members 64 corresponding to the head units U. The plurality of brushes 50 and the plurality of cap members 64 are arranged alternately along the X direction. Each of the brushes 50 of the third embodiment is formed to be long along the WA direction such that the bristle sheaf 54 spans the total length of the gap G. Each of the cap members 64 seals each of the nozzles N by making contact with the ejection surface S of each of the liquid ejecting units 40 of the head unit U. Note that, in FIG. 9, although one cap member 64 is arranged for each of the head units U, it is also possible to arrange a plurality of cap members 64 for each of the head units U.

As illustrated by the solid lines in FIG. 10, during the printing operation, the plurality of brushes 50 of the cleaning mechanism 28 and the plurality of cap members 64 are held in positions separated from the liquid ejecting head 26. The medium 12 is transported to pass between the cleaning mechanism 28 and the liquid ejecting head 26. Meanwhile, when the cleaning operation is started, the plurality of brushes 50 move along the Z direction with the plurality of cap members 64, and approaches the liquid ejecting head 26. As illustrated by the broken lines in FIG. 10, in a state in which each of the cap members 64 closely adheres to the ejection surface S of the liquid ejecting unit 40 and the plurality of nozzles N is sealed, the brush 50 (the portion of the tip side of the bristle sheaf 54) enters the gap G of each of the head units U. By generating a negative pressure in the inner portion of the cap member 64 in a state in which the plurality of nozzles N is sealed by the cap member 64, the ink is forcefully discharged and the suction operation which cleans the nozzles N is executed. The ink which is retained in the gap G is absorbed by the inner portion of the bristle sheaf 54 due to the capillary force of the plurality of bristle members 55 which enter the gap G, and the ink is removed from the gap G.

The same effect as in the first embodiment is also realized in the third embodiment. In the third embodiment, since the gap G is cleaned due to the plurality of brushes 50 moving in the Z direction and the bristle sheaf 54 entering the gap G, in comparison with the first embodiment or the second embodiment in which the ink is swept out by causing the brush 50 to move along the gap G, it is possible to suppress the splashing of the ink. In the third embodiment, since it is possible to arrange the cleaning mechanism 28 so as to overlap the liquid ejecting head 26 as viewed from the Z direction, there is also a merit in that it is possible to reduce the size of the printing apparatus 10 as viewed from the Z direction. In the third embodiment, the brushes 50 move in the Z direction with the cap member 64. Therefore, in addition to sealing the nozzles N using the cap member 64, it is possible to execute the cleaning of the gap G using the brush 50. As described above, since each of the brushes 50 moves with the cap member 64, in comparison to a configuration in which the brush 50 is caused to move independently from the cap member 64, there is a merit in that the configuration and processes for controlling the cleaning mechanism 28 are simplified.

Fourth Embodiment

Figure 11:
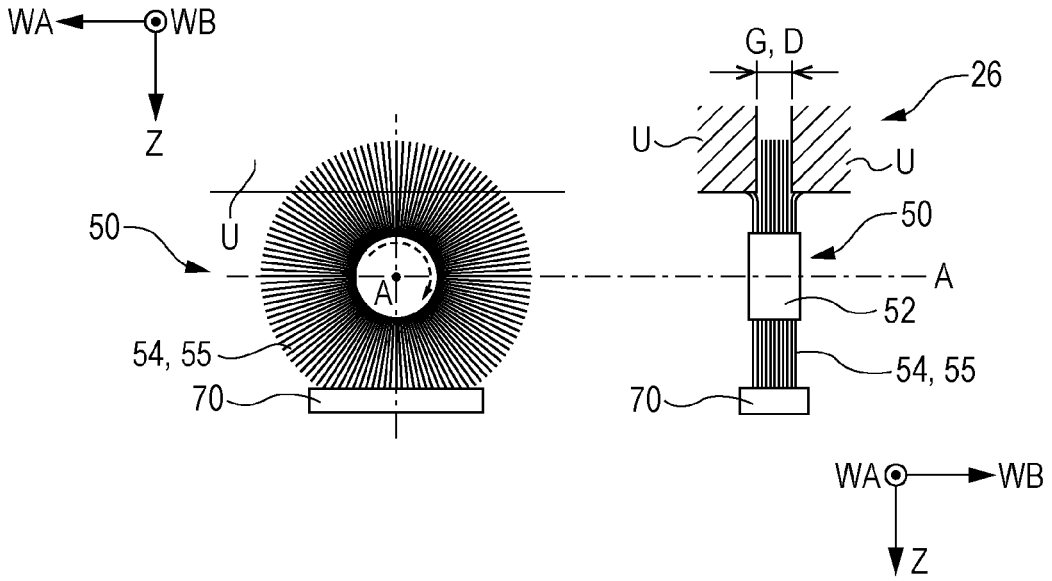
FIG. 11 is a configuration diagram of a brush in a fourth embodiment.

FIG. 11 is a schematic diagram of the cleaning mechanism 28 in the fourth embodiment. In the cleaning mechanism 28 of the fourth embodiment, the brush 50 of FIG. 11 is arranged corresponding to each of the gaps G. As exemplified in FIG. 11, the brush 50 of the fourth embodiment has a structure in which the plurality of bristle members 55 are disposed in a radial shape on the circumferential surface (the side surface) of the disc shaped base portion 52. The base portion 52 rotates around a rotational axis of the WB direction which is parallel to the ejection surface S (the X-Y plane) of each of the liquid ejecting units 40 and orthogonally intersects the WA direction. Specifically, during the cleaning operation, the plurality of brushes 50 are caused to approach the liquid ejecting head 26 until a state is assumed in which the tips of the plurality of bristle members 55 enter the gaps G between the head units U, and the ink of the gaps G is removed by causing the brushes 50 to rotate around a rotational axis A while maintaining the state described above.

A removal member 70 is disposed for each of the brushes 50 on the opposite side from the liquid ejecting head 26 to interpose the brushes 50 of the cleaning mechanism 28. Each of the removal members 70 is a means for removing the ink which is adhered to the brush 50. Specifically, a porous absorbent material with high ink absorption properties (capillary force) in comparison to the brush 50 is favorably used as the removal member 70. Due to a portion of the opposite side of the brush 50 from the liquid ejecting head 26 making contact with the removal member 70 in parallel with an operation in which the ink of the gap G is removed by the rotation of each of the brushes 50, the ink which adheres to the bristle sheaf 54 moves to the removal member 70.

The same effect as in the first embodiment is also realized in the fourth embodiment. In the fourth embodiment, since by causing the disc shaped brush 50 to rotate, the bristle members 55 of a different portion on the circumference of the disc sequentially enter the gap G, there is a merit in that it is possible to effectively clean the gap G in comparison to the first embodiment to the third embodiment. In the fourth embodiment, since the removal member 70 which removes the ink which adheres to the bristle members 55 of the brush 50 is disposed, there is a merit in that it is possible to reduce the likelihood of the ink which adheres to the bristle members 55 re-adhering to the gap G or another location.

Fifth Embodiment

Figure 12:
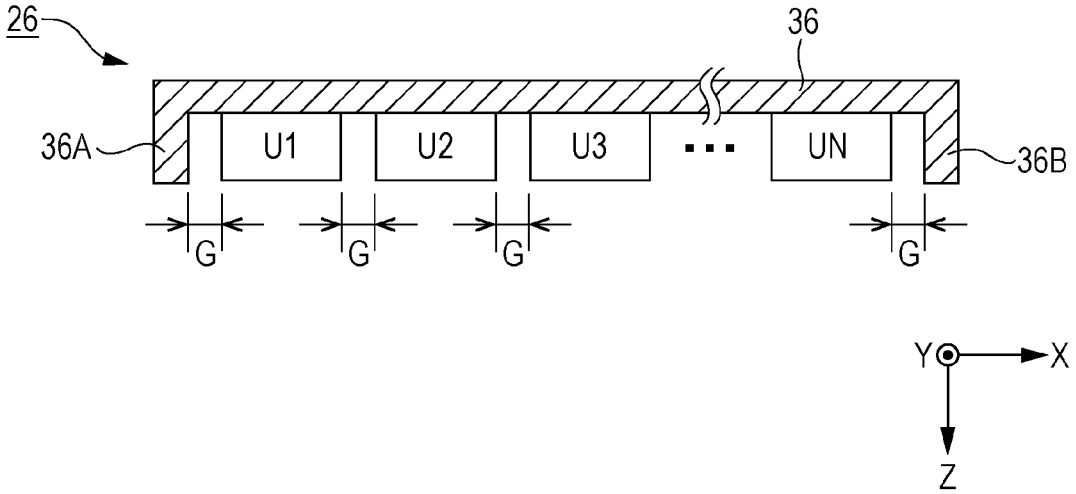
FIG. 12 is a configuration diagram of a liquid ejecting head in a fifth embodiment.
Figure 13:
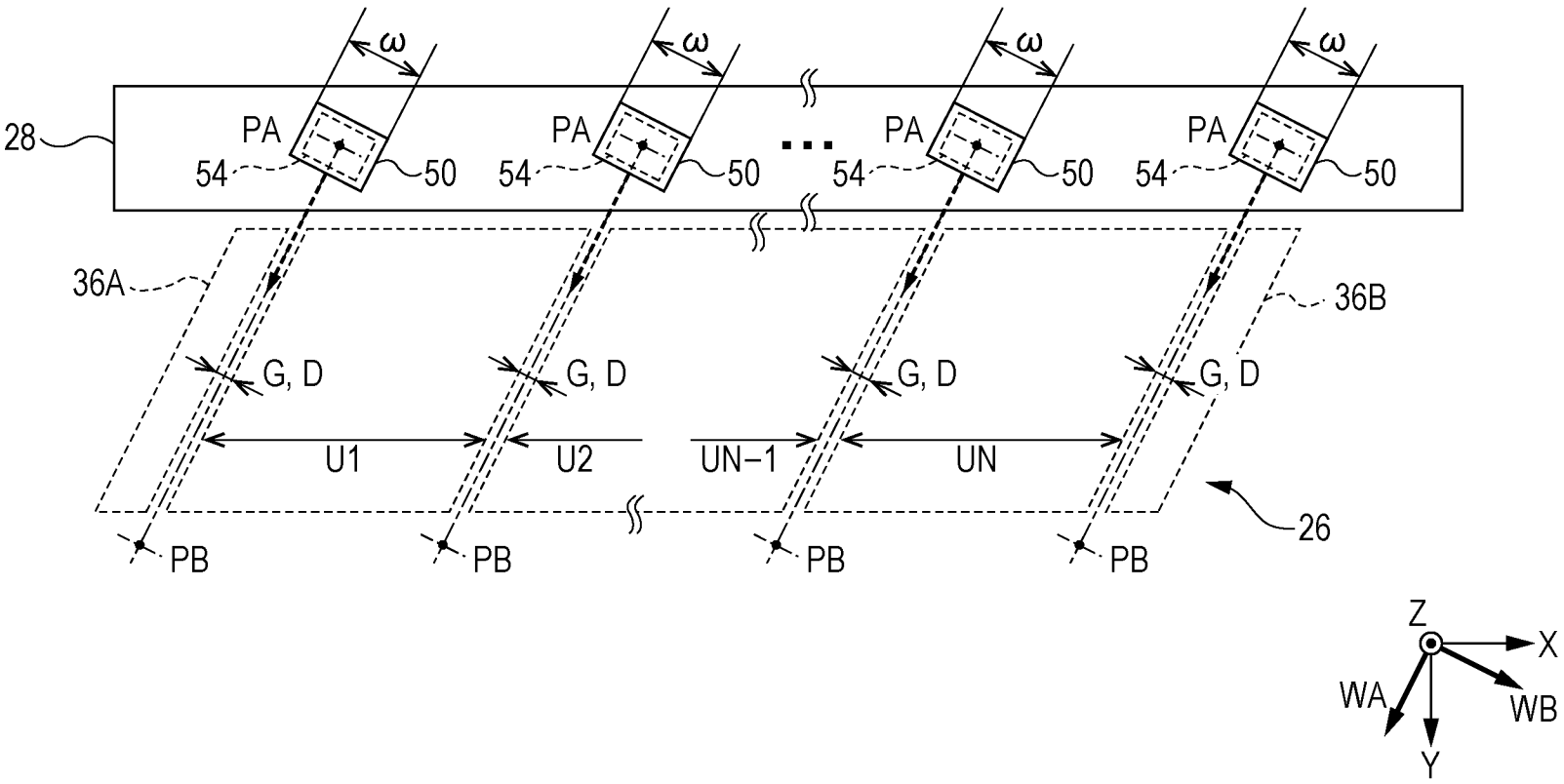
FIG. 13 is a configuration diagram of a cleaning mechanism in the fifth embodiment.

FIG. 12 is a cross sectional diagram of the liquid ejecting head 26 according to the fifth embodiment of the invention, and FIG. 13 is a plan view of the cleaning mechanism 28 in the fifth embodiment. As exemplified in FIG. 12, the liquid ejecting head 26 of the fifth embodiment is provided with the same plurality of head units U (U1 to UN) as in the first embodiment, and a housing 36 which holds the plurality of head units U in a state in which the head units U are arranged along the X direction. The housing 36 of the fifth embodiment is a structural body which is long in the X direction and is formed using die casting of a metal material or extrusion formation of a resin material, for example, and includes a side surface portion 36A which is positioned on the end portion of the negative side of the X direction and a side surface portion 36B which is positioned on the end portion of the positive side. The plurality of head units U is held between the side surface portion 36A and the side surface portion 36B.

The side surface portion 36A faces the side surface of a single head unit U1 which is positioned on the end portion of the negative side of the X direction of the plurality of head units U, and the side surface portion 36B faces the side surface of a single head unit UN which is positioned on the end portion of the positive side of the X direction of the plurality of head units U. As exemplified in FIGS. 12 and 13, the gaps G which extend along the WA direction in plan view are present between the side surface portion 36A and the head unit U1 and between the side surface portion 36B and the head unit UN in the same manner as the gaps G which are present between the head units U which are adjacent to each other.

As exemplified in FIG. 13, in addition to the brushes 50 for cleaning the gaps G between the head units U, the cleaning mechanism 28 of the fifth embodiment is provided with the brushes 50 for cleaning the gaps G between the housing 36 (the side surface portion 36A and the side surface portion 36B) and the head units U. The structure of each of the brushes 50 and the content (the movement conditions and the like) of the cleaning of the gaps G using the brushes 50 is the same as in the first embodiment. Therefore, according to the fifth embodiment, in addition to the same effect as in the first embodiment, an effect is realized in which it is possible to effectively clean the gap G even when there is a gap G between the housing 36 and the head unit U.

Note that, in the cleaning of the gap G between the housing 36 and the head unit U, it is possible to adopt the same overall configuration exemplified with regard to the cleaning of the gap G between the head units U in the first embodiment to the fourth embodiment. In the above description, the cleaning mechanism 28 is exemplified which is provided with both the brush 50 for cleaning the gap G between the head units U, and the brush 50 for cleaning the gap G between the housing 36 and the head unit U; however, a configuration may be adopted in which the cleaning mechanism 28 is provided with only the brush 50 for cleaning the gap G between the housing 36 and the head unit U (a configuration in which the brush 50 corresponding to the gap G between the head units U is omitted).

As can be understood from the exemplifications described above, the target of the cleaning carried out by the brush 50 of the cleaning mechanism 28 is comprehensively expressed as the gap G which is formed by the head unit U, and, in addition to the gap G between the head units U exemplified in the first embodiment to the fourth embodiment, the gap G between the head unit U and another element (for example, the housing 36) exemplified in the fifth embodiment is included.

Modification Example

The embodiments exemplified above can be subjected to various modifications. Aspects of specific modifications will be exemplified below. Two or more aspects arbitrarily selected from the following exemplifications may be used together, as appropriate, notwithstanding any contradictions therebetween.

(1) In the second embodiment, a configuration is exemplified in which the brush 50 is caused to move integrally with the wiper member 62; however, a configuration may be adopted in which the brush 50 is caused to move independently from the wiper member 62. In the same manner, in the third embodiment, a configuration is exemplified in which the brush 50 is caused to move integrally with the cap member 64; however, it is possible to cause the brush 50 to move independently from the cap member 64.

Figure 14:
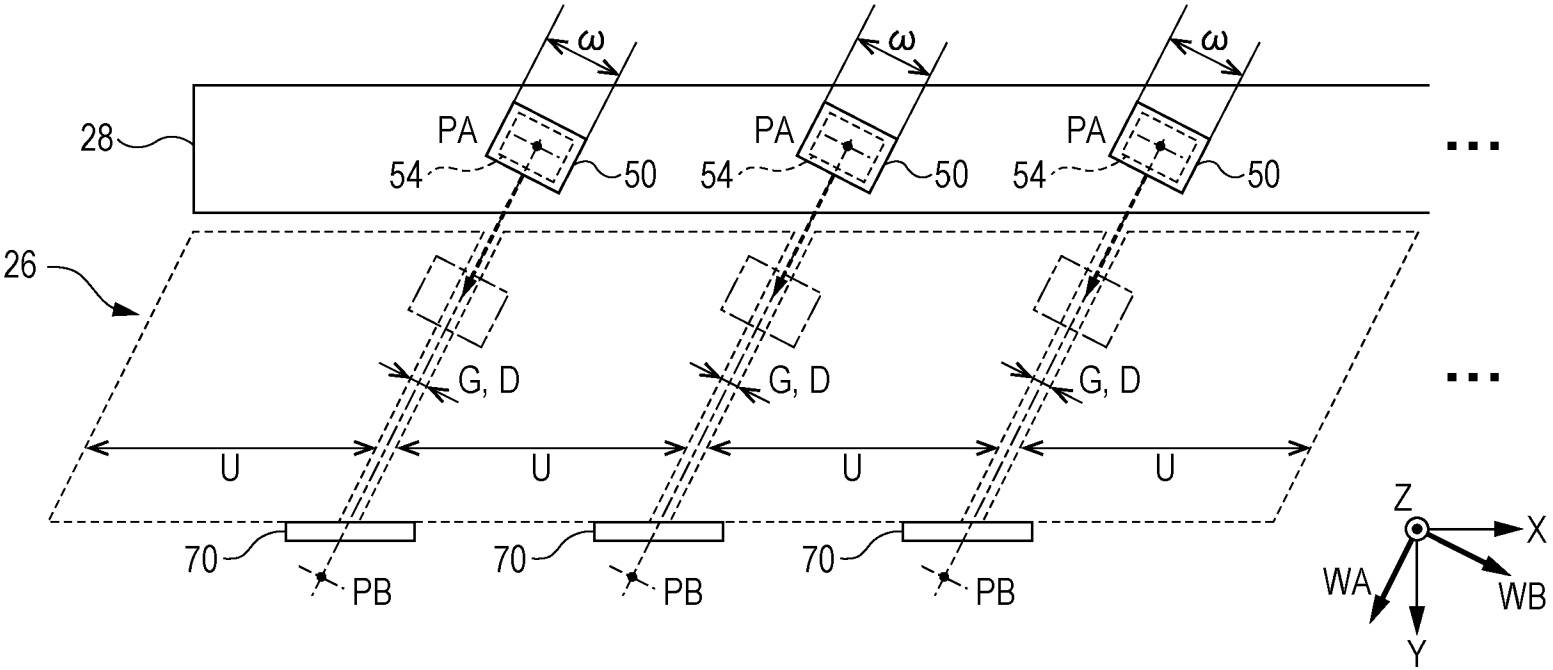
FIG. 14 is a configuration diagram of a printing apparatus in a modification example.

(2) In the fourth embodiment, the removal member 70 which removes the ink which adheres to the brush 50; however, it is possible to dispose the same removal member 70 in the first embodiment to the third embodiment, and the fifth embodiment. For example, as exemplified in FIG. 14, in the first embodiment and the second embodiment, it is possible to dispose the removal member 70 on the downstream side of the liquid ejecting head 26 in the movement path from the point PA to the point PB.

Note that, in the fourth embodiment, the porous absorbent material (a sponge) is exemplified as the removal member 70; however, the configuration and material of the removal member 70 is not limited to the aforementioned exemplification. For example, it is possible to use a member which is caused to make contact with the bristle members 55 of the brush 50 to wipe off the ink, or a member (a projecting portion) which removes the ink by elastically flicking the tip side of the bristle members 55 of the brush 50, as the removal member 70 in each of the embodiments described earlier.

(3) In each of the embodiments described earlier, a configuration is exemplified in which all of the bristle members 55 which form the bristle sheaf 54 of the brush 50 have the same properties; however, it is possible to form the bristle sheaf 54 using a plurality of types of the bristle member 55 which have different properties (total length, diameter, material). In each of the embodiments described earlier, a configuration is exemplified in which the diameter of each of the bristle members 55 of the brush 50 is smaller than the inner diameter of the nozzle N; however, a configuration may be adopted in which the diameter of each of the bristle members 55 is larger than the inner diameter of the nozzle N. In a configuration in which the inner diameter of the nozzle N exceeds the diameter of the bristle member 55, since the tip of the bristle member 55 will not enter the inner portion of the nozzle N, there is a merit in that it is possible to prevent the destruction of the meniscus of the inner portion of the nozzle N (in addition to the entrance of bubbles caused by the destruction).

(4) In the first embodiment and the second embodiment, a configuration is exemplified in which the brush 50 is caused to move along the WB direction in relation to the liquid ejecting head 26; however, a configuration may be adopted in which each of the brushes 50 of the cleaning mechanism 28 is fixed and the liquid ejecting head 26 is caused to move along the WB direction in relation to the brush 50. In other words, the configuration in which the brush 50 is caused to move in relation to the liquid ejecting head 26 and the configuration in which the liquid ejecting head 26 is caused to move in relation to the brush 50 are included in a configuration in which the brush 50 is moved relative to the liquid ejecting head 26 (the gap G, that is, a configuration in which one of the liquid ejecting head 26 and the brush 50 is caused to move in relation to the other). The same applies to the wiper member 62 and the cap member 64, and in addition to a configuration in which the wiper member 62 or the cap member 64 is caused to move in relation to the liquid ejecting head 26 as exemplified in each of the embodiments described earlier, it is possible to adopt a configuration in which the liquid ejecting head 26 is caused to move in relation to the wiper member 62 or the cap member 64.

(5) The system used by the liquid ejecting head 26 to eject the ink is not limited to the system described earlier which uses a piezoelectric element (a piezo system). For example, the invention can also be applied to a liquid ejecting head of a system which uses a heating element to change the pressure within the pressure chamber by generating bubbles within the pressure chamber by heating the pressure chamber (a thermal system).

(6) In addition to a device which is specialized for printing, it is possible to adopt various types of device such as a facsimile apparatus or a copier as the printing apparatus 10 which is exemplified in each of the embodiments described above. Naturally, the purpose of the liquid ejecting apparatus of the invention is not limited to printing. For example, a liquid ejecting apparatus which ejects a color material solution is used as a manufacturing apparatus which forms a color filter of a liquid crystal display apparatus. A liquid ejecting apparatus which ejects a conductive material solution is used as a manufacturing apparatus which forms the wiring and electrodes of a wiring substrate.

What is claimed is:

1. A liquid ejecting apparatus, comprising:

a liquid ejecting head in which a plurality of head units which eject a liquid from a nozzle which is formed in an ejection surface are arranged along a first direction; and a brush which includes a plurality of bristle members for cleaning a gap which is formed between the head units or formed between one of the head units and a member that holds the head units.

2. The liquid ejecting apparatus according to claim 1, wherein the gap which is formed by the head units extends along a second direction which intersects the first direction, and wherein a dimension of a bristle sheaf of the plurality of bristle members in a third direction which orthogonally intersects the second direction is greater than an interval of the gap.

3. The liquid ejecting apparatus according to claim 1, wherein the length of the plurality of bristle members is selected such that a tip of each of the bristle members of the plurality of bristle members other than the bristle members which enter the gap does not reach the nozzle.

4. The liquid ejecting apparatus according to claim 1, wherein a diameter of each of the bristle members is smaller than an inner diameter of the nozzle.

5. The liquid ejecting apparatus according to claim 1, wherein a diameter of each of the bristle members is greater than an inner diameter of the nozzle.

6. The liquid ejecting apparatus according to claim 1, wherein the gap which is formed by the head units extends along a second direction which intersects the first direction, and wherein the brush moves relative to the gap along the second direction.

7. The liquid ejecting apparatus according to claim 1, further comprising:

a wiper member which wipes the ejection surface, wherein, after the gap is cleaned by the brush, the wiper member wipes the ejection surface.

8. The liquid ejecting apparatus according to claim 1, wherein the gap which is formed by the head units extends along a second direction which intersects the first direction, and wherein the brush rotates around a rotational axis which is parallel to the ejection surface and orthogonally intersects the second direction.

9. The liquid ejecting apparatus according to claim 1, wherein the brush moves relative to the ejection surface along a direction perpendicular to the ejection surface.

10. The liquid ejecting apparatus according to claim 9, further comprising:

a cap member which seals the ejection surface, wherein the brush moves relative to the ejection surface with the cap member.

11. The liquid ejecting apparatus according to claim 1, further comprising:

a removal unit which removes a liquid which adheres to the brush from the brush.

12. The liquid ejecting apparatus according to claim 1, wherein a side surface of the head unit includes a first region and a second region which is positioned on the ejection surface side in a direction perpendicular to the ejection surface from a perspective of the first region, wherein the second region has a higher hydrophobicity than the first region, and wherein, of the plurality of bristle members, a tip of each of the bristle members which enters the gap reaches the first region.

* * * * *